US009579766B2

(12) United States Patent
Greenslet

(10) Patent No.: US 9,579,766 B2
(45) Date of Patent: Feb. 28, 2017

(54) SYSTEM AND METHOD OF MAGNETIC ABRASIVE SURFACE PROCESSING

(71) Applicant: University of Florida Research Foundation, Inc., Gainesville, FL (US)

(72) Inventor: Hitomi Greenslet, Gainesville, FL (US)

(73) Assignee: UNIVERSITY OF FLORIDA RESEARCH FOUNDATION, Gainesville, FL (US)

( * ) Notice: Subject to any disclaimer, the term of this patent is extended or adjusted under 35 U.S.C. 154(b) by 0 days.

(21) Appl. No.: 14/381,856

(22) PCT Filed: Feb. 25, 2013

(86) PCT No.: PCT/US2013/027576

§ 371 (c)(1),
(2) Date: Aug. 28, 2014

(87) PCT Pub. No.: WO2013/130379

PCT Pub. Date: Sep. 6, 2013

(65) Prior Publication Data

US 2015/0093970 A1 Apr. 2, 2015

Related U.S. Application Data

(60) Provisional application No. 61/604,097, filed on Feb. 8, 2012.

(51) Int. Cl.

| | |
|---|---|
| ***B24B 31/112*** | (2006.01) |
| ***B24B 19/02*** | (2006.01) |
| ***B24B 31/10*** | (2006.01) |
| ***B24B 1/00*** | (2006.01) |

(52) U.S. Cl.
CPC ..... *B24B 31/102* (2013.01); *B24B 1/005* (2013.01); *B24B 19/02* (2013.01); *B24B 31/112* (2013.01)

(58) Field of Classification Search
CPC ..... B24B 1/005; B24B 19/02; B24B 31/102; B24B 31/112
USPC ..... 451/35, 36, 54, 59
See application file for complete search history.

(56) References Cited

U.S. PATENT DOCUMENTS 4,306,386 A * 12/1981 Sakulevich ..... B24B 1/005 451/113
5,449,313 A * 9/1995 Kordonsky ..... B24B 1/005 451/104
5,569,061 A * 10/1996 Kremen ..... B24C 5/08 451/103

(Continued)

FOREIGN PATENT DOCUMENTS

JP 05111821 * 5/1993
JP 2005177894 * 7/2005

(Continued)

*Primary Examiner* — Eileen Morgan
(74) *Attorney, Agent, or Firm* — Thomas|Horstemeyer, LLP.

(57) ABSTRACT

Disclosed are various embodiments for a system and method of processing a surface using a mixture containing magnetic particles. A mixture is disposed on a workpiece and exposed to a dynamic magnetic field. In response to the dynamic magnetic field, the magnetic particles of the mixture may move along the workpiece. The movement of the magnetic particles creates a pattern of grooves on the surface of the workpiece.

19 Claims, 2 Drawing Sheets

(56) References Cited

U.S. PATENT DOCUMENTS

| | | | | | |
|---|---|---|---|---|---|
| 5,775,976 | A * | 7/1998 | Kremen | B24B 1/04 | 451/36 |
| 6,139,407 | A * | 10/2000 | Shinbo | B24B 31/112 | 451/113 |
| 6,146,245 | A * | 11/2000 | Kremen | B24B 37/04 | 451/165 |
| 6,503,414 | B1 * | 1/2003 | Kordonsky | B24B 1/005 | 252/62.52 |
| 7,097,540 | B1 | 8/2006 | Gosinski et al. | | |
| 2006/0211337 | A1 * | 9/2006 | Thiel | B24B 1/005 | 451/11 |
| 2008/0289262 | A1 | 11/2008 | Gao | | |
| 2011/0244759 | A1 | 10/2011 | Sutton | | |

FOREIGN PATENT DOCUMENTS

| | | | |
|---|---|---|---|
| KR | 10-0323065 | B1 | 2/2002 |
| KR | 10-2011-0030721 | A | 3/2011 |

* cited by examiner

SYSTEM AND METHOD OF MAGNETIC ABRASIVE SURFACE PROCESSING

CROSS-REFERENCE TO RELATED APPLICATIONS

This application is the 35 U.S.C. §371 national stage of PCT Application No. PCT/US2013/027576, filed Feb. 25, 2013, which is entirely incorporated herein by reference and which also claims priority to, and the benefit of, U.S. provisional application entitled "SYSTEM AND METHOD OF MAGNETIC ABRASIVE SURFACE FINISHING" having Ser. No. 61/604,097, filed on Feb. 28, 2012, which is entirely incorporated herein by reference.

STATEMENT REGARDING FEDERALLY SPONSORED RESEARCH OR DEVELOPMENT

This invention was made with government support under Grant/Contract Number CMMI-0855381 awarded by the National Science Foundation. The government has certain rights in the invention.

BACKGROUND

A freeform surface, such as the femoral component of a knee prosthetic, may require a specific surface pattern and a particularized level of roughness to meet certain specifications. As such, a freeform surface may be shaped and buffed in order to meet these specifications. Processing by hand may raise production costs, increase deviations in surface quality, and limit the variations in surface roughness and topography.

BRIEF DESCRIPTION OF THE DRAWINGS

Many aspects of the present disclosure can be better understood with reference to the following drawings. The components in the drawings are not necessarily to scale, emphasis instead being placed upon clearly illustrating the principles of the disclosure.

DETAILED DESCRIPTION

The present disclosure is directed towards the use of Magnetic Abrasive Finishing (MAF) to process freeform surfaces. As a non-limiting example, a mixture comprising, for example, magnetic particles, abrasive particles, and/or lubricant is applied to a workpiece. The mixture is then exposed to a rotating magnetic field, causing the components of the mixture to move along the surface of the workpiece. Additionally, the workpiece may be moved in the x, y, and/or z directions with respect to the magnetic field. The movement of the abrasive particles in the mixture with respect to the workpiece can cause patterns to be created on the surface of the workpiece. Accordingly, physical properties of the workpiece may be modified due to the patterns. For example, the wettability, reflectivity, friction characteristics, wear characteristics, resistance to micro-organisms, and/or other properties of the workpiece may be affected.

In some cases, another mixture may be applied to the workpiece, and the mixture may be exposed to the rotating magnetic field. The mixture may move along the surface of the workpiece in response to the rotating magnetic field and reduce the surface roughness of the workpiece. The workpiece may also be moved in the x, y, and/or z directions with respect to the magnetic field. Thus, in accordance with the present disclosure, the workpiece may retain the created patterns while having a reduced surface roughness. In the following discussion, a general description of the system and its components is provided, followed by a discussion of the operation of the same.

Figure 1:
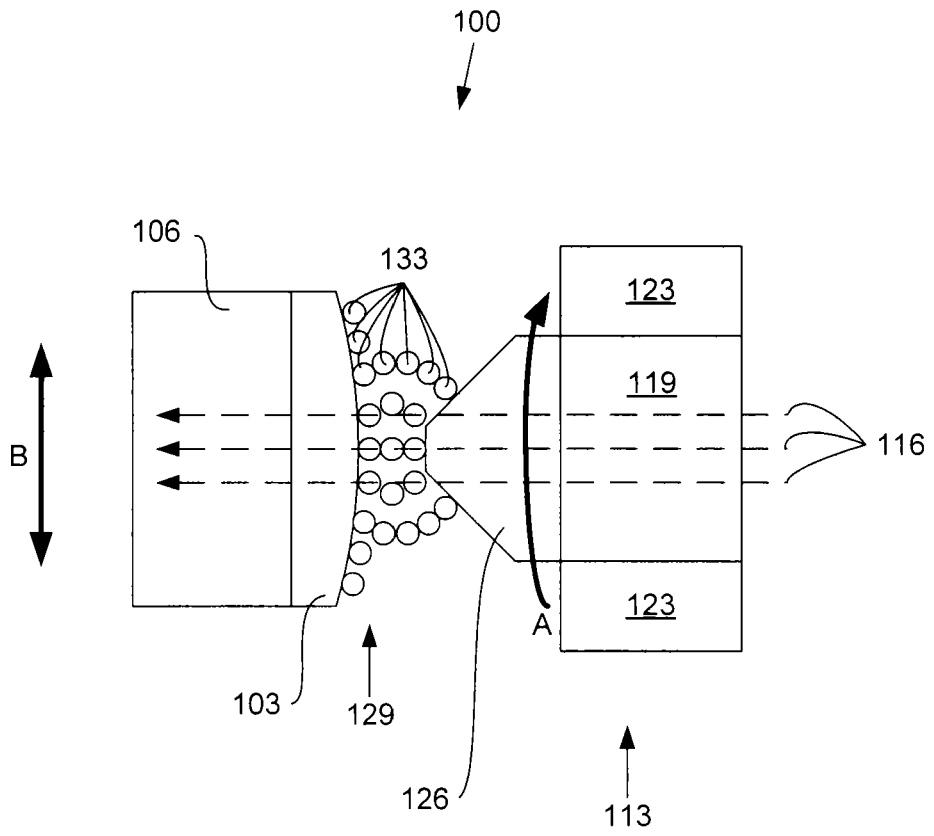
FIG. 1 is a drawing representing a cross-section of a magnetic abrasive processing system according to various embodiments of the present disclosure.

Turning to FIG. 1, shown is a cross-section diagram representing an example of a magnetic abrasive processing system 100 according to various embodiments of the present disclosure. The magnetic abrasive processing system 100 may include a workpiece 103, a workpiece holder 106, a magnetic field generator 113, and possibly other components not discussed in detail herein.

The workpiece 103 may be any object that is subject to the surface processing described herein. According to various embodiments, the workpiece 103 may have one or more freeform surfaces. As non-limiting examples, the workpiece 103 may be a medical prosthesis (e.g., the femoral component of a knee prosthetic or a hip replacement), an aerospace component, an optical component, a die, a mold, or any other type of object for which the surface is to be processed. The workpiece 103 may or may not include a coating according to various embodiments. When subject to the processing described herein, the workpiece 103 may be shaped and/or the surface of the workpiece 103 may be patterned and/or polished.

The workpiece holder 106 may hold and stabilize the workpiece 103. Additionally, the workpiece holder 106 may move the workpiece 103 in the x, y, and/or z directions with respect to the magnetic field generator 113. Even further, the workpiece holder 106 may be used to vibrate, rotate, or move the workpiece 103 in other ways relative to the magnetic field generator 113. To this end, the workpiece holder 106 may be attached to a robotic arm (not shown), for example, or any other type of positioning device capable of movement in one or more dimensions.

The magnetic field generator 113 creates a magnetic field 116 that may be constant or dynamic. To this end, the magnetic field generator 113 may be embodied in the form of an electromagnet or a permanent magnet, for example. Accordingly, various embodiments of the magnetic field generator 113 may include a core 119 and an energized coil 123 to generate the magnetic field 116. The magnetic field generator 113 may also include a pole tip 126 that directs the magnetic field 116. In this respect, the pole tip 126 may direct the flux lines of the magnetic field 116 between the magnetic field generator 113 and the workpiece 103. Additionally, the pole tip 126 may be configured to rotate in the direction indicated by arrow A and/or in the opposite direction. In this regard, the pole tip 126 may rotate about a longitudinal axis for the pole tip 126. In alternative embodiments, the pole tip 126 may be moved in a rotational fashion to produce rotational movement of a mixture 129 that may be applied to the workpiece 103.

Various attributes may be associated with the magnetic field 116. As non-limiting examples, the magnetic field strength, the rate of revolution, the direction of revolution, and possibly other attributes may be associated with the magnetic field 116. The attributes may be controlled by the magnetic field generator 113 or by using other techniques.

Such attributes may be varied or otherwise controlled to achieve desired processing effects on a workpiece 103 as is described herein.

A mixture 129 may be applied to the workpiece 103. The mixture 129 may include various components, such as magnetic particles 133, abrasive particles (not shown), lubricant (not shown), and/or other components. In the presence of a magnetic field 116, the magnetic particles 133 may align with the magnetic field 116 and form flexible "chains" between the workpiece 103 and the pole tip 126. In this sense, the magnetic particles 133 may form a flexible connection between the workpiece 103 and the pole tip 126 in approximate alignment with the magnetic field 116.

Additionally, as the magnetic field 116 is adjusted, the magnetic particles 133 respond accordingly. For instance, if the magnetic field 116 rotates, the chains of the magnetic particles 133 may rotate in conjunction with the magnetic field 116. As another example, if the strength of the magnetic field 116 is increased, the flexible chains of the magnetic particles 133 may become more rigid in response to the increased strength of the magnetic field 116. Furthermore, if the strength of the magnetic field 116 is decreased, the flexible chains of magnetic particles 133 may become less rigid in response to the decreased strength of the magnetic field 116.

Various characteristics may be associated with the mixture 129 and/or its components. Such characteristics may be, for example, the types of particles in the mixture 129, the amount of the mixture 129 (e.g., its mass), the particle size(s), the particle composition, the ratio of magnetic particles 133 to abrasive particles, or other characteristics. By configuring the mixture 129 to have particular characteristics, the mixture 129 may be used to create particular patterns on and/or a particular surface roughness for the workpiece 103. For instance, patterns comprising continuous and/or non-continuous grooves may be created on the surface of the workpiece 103. Additionally, grooves that are substantially parallel with respect to each other may be created in the surface of the workpiece 103. Furthermore, cross-hatched grooves may be created on the surface of the workpiece 103.

Next, a general description of the operation of the various components of the magnetic abrasive processing system 100 is provided. To begin, it is assumed that a mixture 129 has been applied to the workpiece 103 and that the magnetic field generator 113 is energized and providing a magnetic field 116.

The pole tip 126 may begin rotating in the direction indicated by arrow A. Because the pole tip 126 directs the magnetic field 116, the magnetic field 116 may rotate in accordance with the pole tip 126. In turn, the chains of magnetic particles 133 that respond to the magnetic flux lines of the magnetic field 116 may rotate as well. The magnetic particles 133 may also cause the abrasive particles to move along the surface of the workpiece 103.

The moving magnetic particles 133 and/or abrasive particles may cause patterns to be created in the surface of the workpiece 103. The patterns may include multiple grooves that are formed in the surface of the workpiece 103. In accordance with the present disclosure, various attributes of the magnetic field 116 and/or characteristics of the mixture 129 may be chosen so as to determine features of the grooves and thus the patterns on the workpiece 103.

For example, applying a relatively strong magnetic field 116 may result in the flexible chains of the magnetic particles 133 being relatively rigid, thereby creating continuous grooves in the surface of the workpiece 103. Furthermore, applying a relatively weak magnetic field 116 may result in the flexible chains of the magnetic particles 133 being less rigid, thereby causing non-continuous grooves to be created in the surface of the workpiece 103. Additionally, the magnetic field 116 may be pulsed or alternated in direction and/or magnitude to affect the characteristics of the grooves that may be created on the surface of the workpiece 103.

Furthermore, in various embodiments, the movement of the magnetic field 116 with respect to the workpiece 103 may be specified so that various types of grooves are formed on the workpiece 103. For instance, the motion of the workpiece 103 relative to the pole tip 126, or the motion of the pole tip 126 relative to the workpiece 103 may be specified so as to form grooves that are substantially parallel to each other. In alternative embodiments, the characteristics for the magnetic field 116 and/or the movement of the magnetic field 116 with respect to the workpiece may be chosen such that cross-hatched grooves or other types of grooves are created in the surface of the workpiece 103. These grooves may affect surface properties of the workpiece 103, such as its wettability, reflectivity, friction characteristics, wear characteristics, resistance to micro-organisms, and/or other properties.

The surface roughness of the workpiece 103 may also be reduced. To this end, the workpiece 103 may be cleaned, and another mixture 129 may be applied to the workpiece 103. This other mixture 129 may be the same type or may be different from the mixture 129 that was previously used to create the cutting marks in the surface of the workpiece 103. The characteristics of the mixture 129 may be selected in order to facilitate reducing the surface roughness of the workpiece 103 while maintaining or altering the previously created patterns in the workpiece 103.

The process of rotating the magnetic field 116 and the magnetic particles 133 may be repeated to reduce the surface roughness and/or change the surface topography of the workpiece 103. Additionally, attributes of the magnetic field 116 may be selected and/or adjusted to facilitate this operation. For example, the strength of the magnetic field 116, the rate of rotation of the magnetic field 116 and/or the pole tip 126, and/or the rate of moving the workpiece 103 with respect to the magnetic field 116 may be selected and/or adjusted to reduce the surface roughness and/or change the surface topography of the workpiece 103.

Figure 2A:
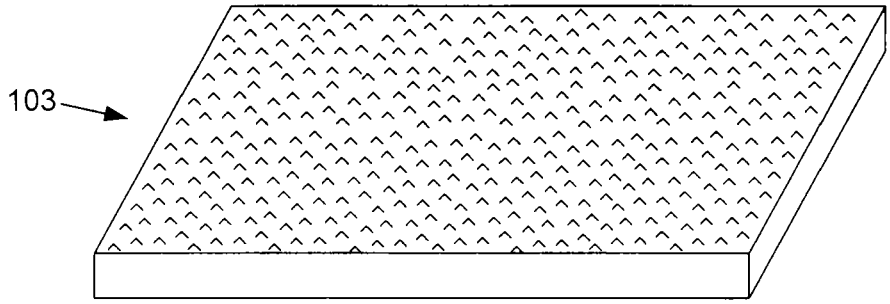
FIGS. 2A-2C are drawings showing a portion of a workpiece subject to the magnetic abrasive processing system of FIG. 1 according to various embodiments of the present disclosure.

With reference to FIG. 2A, shown is a drawing showing a portion of a workpiece 103 subject to the magnetic abrasive processing system 100 (FIG. 1) according to various embodiments of the present disclosure. In particular, shown is a portion of a workpiece 103 prior to the workpiece 103 being processed by the magnetic abrasive processing system 100. As shown, the workpiece 103 may have a relatively rough surface. Additionally, the surface of the workpiece 103 may have scratches (not shown) or other types of features that may not be desirable for the workpiece 103.

Figure 2B:
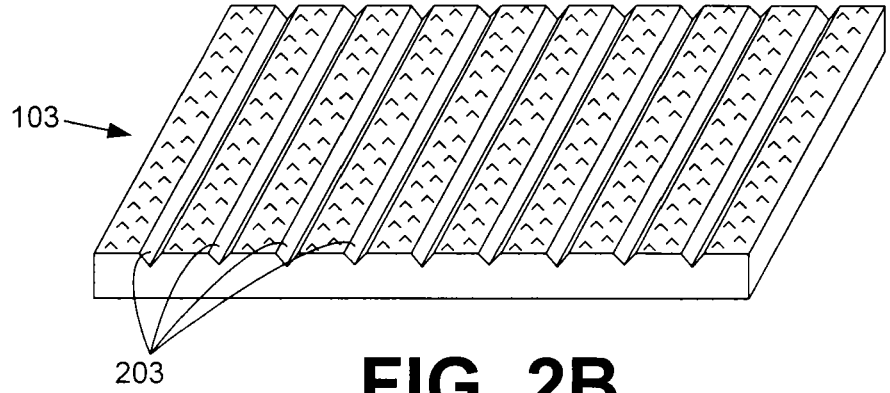

Turning to FIG. 2B, shown is another drawing showing a portion of the workpiece 103 subject to the magnetic abrasive processing system 100 (FIG. 1) according to various embodiments of the present disclosure. In particular, shown in FIG. 2A is a portion of the workpiece 103 of FIG. 2A after the magnetic abrasive processing system 100 has generated a pattern comprising grooves 203 in the surface of the workpiece 103. To this end, the magnetic particles 133 in the mixture 129 (FIG. 1) may have been displaced along the surface of the workpiece 103 by the rotating magnetic field 116. As a result, the magnetic particles 133 (FIG. 1) and/or the abrasive particles in the mixture 129 may have cut into the surface of the workpiece 103, thereby generating the grooves 203.

In the example of FIG. 2B, the grooves 203 are continuous and are substantially parallel with respect to each other. In order to generate different types of patterns in the surface of the workpiece 103, the characteristics for the mixture 129 and/or the magnetic field 116 may be chosen to result in the desired pattern. According to the characteristics selected for a particular application, the grooves 203 for the pattern may be, for example, continuous, non-continuous, substantially parallel, cross-hatched, and/or any other type of arrangement.

Figure 2C:
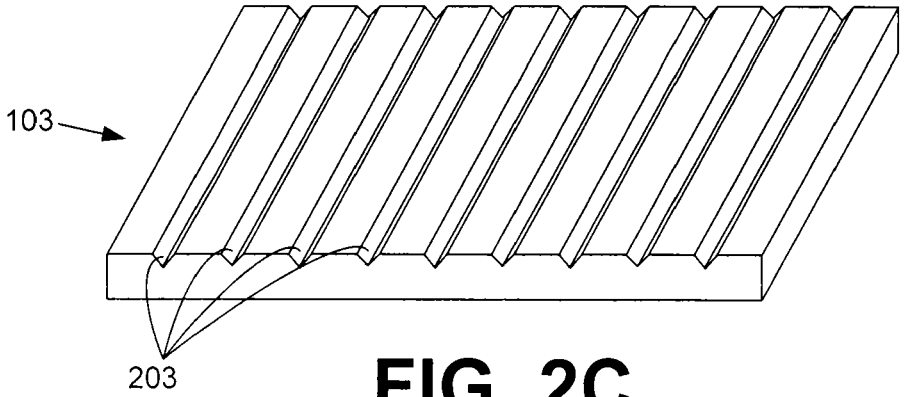

Turning to FIG. 2C, shown is another drawing showing a portion of the workpiece 103 subject to the magnetic abrasive processing system 100 (FIG. 1) according to various embodiments of the present disclosure. In particular, shown is a portion of the workpiece 103 of FIGS. 2A-2B after the magnetic abrasive processing system 100 has reduced the surface roughness of the workpiece 103. To this end, characteristics for the mixture 129 (FIG. 1) and the magnetic field 116 may be chosen to result in the surface roughness of the workpiece being reduced. By selecting the characteristics for the mixture 129 (FIG. 1) or the magnetic field 116 (FIG. 1), the surface roughness of the workpiece 103 may be reduced to a desired level. In addition, the workpiece may retain the created grooves 203 while having a reduced surface roughness. As a result, the wettability, reflectivity, friction characteristics, wear characteristics, resistance to micro-organisms, and other characteristics of the workpiece may be affected. Additionally, in alternative embodiments, the characteristics of the mixture 129 and/or the magnetic field 116 may be chosen and applied to increase the surface roughness of the workpiece 103.

It is emphasized that the above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

The invention claimed is:

1. A system, comprising:

a workpiece comprising a mixture disposed on a surface of the workpiece, the mixture comprising a plurality of magnetic particles and a plurality of abrasive particles;

a robotic arm comprising a workpiece holder holding the workpiece, the robotic arm configured to adjust a position of the workpiece; and a magnetic field generator adjacent to the surface of the workpiece, where the magnetic field generator exposes the magnetic particles to a magnetic field extending between a pole tip of the magnetic field generator and the workpiece holder through the workpiece, the pole tip configured to cause the magnetic field to rotate with respect to the workpiece and workpiece holder, wherein the workpiece holder moves relative to the pole tip to displace the magnetic particles along the surface of the workpiece and generate a pattern comprising a plurality of grooves on the surface of the workpiece using the abrasive particles.

2. The system of claim 1, wherein the magnetic field generator is further configured to adjust a characteristic of the plurality of grooves generated on the surface of the workpiece by adjusting an attribute of the magnetic field.

3. The system of claim 2, wherein the attribute comprises at least one of a strength of the magnetic field, a rotation rate of the magnetic field, or a direction of the magnetic field.

4. The system of claim 1, wherein the plurality of grooves comprise cross-hatched grooves.

5. A method, comprising:

applying a mixture comprising a plurality of magnetic particles and abrasive particles to a surface of a workpiece held by a workpiece holder;

exposing the mixture to a magnetic field produced by a magnetic field generator adjacent to the surface of the workpiece, the magnetic field extending between a pole tip of the magnetic field generator and the workpiece holder through the workpiece, where dynamically adjusting the magnetic field with respect to the workpiece and workpiece holder and moving the workpiece holder relative to the pole tip creates a pattern on the surface of the workpiece, the pattern comprising a plurality of grooves.

6. The method of claim 5, wherein at least a portion of the plurality of grooves are non-continuous.

7. The method of claim 5, wherein at least a portion of the plurality of grooves is continuous.

8. The method of claim 5, further comprising adjusting an attribute of the magnetic field to adjust a characteristic of the plurality of grooves.

9. The method of claim 8, wherein the attribute comprises at least one of a magnetic field strength, a rate of revolution of the magnetic field, or a direction of the magnetic field.

10. The method of claim 5, wherein dynamically adjusting the magnetic field comprises rotating the pole tip of the magnetic field generator to cause the magnetic field to be dynamic with respect to the workpiece.

11. The method of claim 5, further comprising:

applying a second mixture to the surface of the workpiece; and exposing the second mixture to the magnetic field and dynamically adjusting the magnetic field with respect to the workpiece and the workpiece holder to adjust a roughness of the surface of the workpiece while maintaining at least a portion of the pattern on the workpiece.

12. A system, comprising:

a workpiece holder configured to hold a workpiece;

a mixture of magnetic particles and abrasive particles disposed on a surface of the workpiece; and a magnetic field generator adjacent to the surface of the workpiece, where the magnetic field generator provides a magnetic field that extends between a pole tip of the magnetic field generator and the workpiece holder through the workpiece, wherein the magnetic field is rotating with respect to the surface of the workpiece and the magnetic field that generates a pattern on the surface of the workpiece by displacing the workpiece holder relative to the mixture on the surface of the workpiece, the pattern comprising a plurality of grooves on the surface of the workpiece.

13. The system of claim 12, wherein at least a portion of the plurality of grooves are non-continuous.

14. The system of claim 12, wherein at least a portion of the plurality of grooves is continuous.

15. The system of claim 12, wherein the plurality of grooves comprise cross-hatched grooves.

16. The system of claim 12, wherein the magnetic field generator affects a characteristic of the plurality of grooves by adjusting an attribute of the magnetic field.

17. The system of claim 16, wherein the attribute comprises at least one of a magnetic field strength, a rate of revolution of the magnetic field, or a direction of the magnetic field.

18. The system of claim 12, wherein the pole tip of the magnetic field generator is configured to rotate with respect to the workpiece and the workpiece holder to cause the magnetic field to rotate.

19. The system of claim 12, further comprising a robotic arm configured to move the workpiece holder with respect to the magnetic field generator.

* * * * *